US008152264B2

(12) United States Patent
Takahashi

(10) Patent No.: US 8,152,264 B2
(45) Date of Patent: Apr. 10, 2012

(54) INKJET PRINTING APPARATUS

(75) Inventor: Mituru Takahashi, Miyagi (JP)

(73) Assignee: Tohoku Ricoh Co., Ltd, Shibata-gun (JP)

( * ) Notice: Subject to any disclaimer, the term of this patent is extended or adjusted under 35 U.S.C. 154(b) by 425 days.

(21) Appl. No.: 12/402,958

(22) Filed: Mar. 12, 2009

(65) Prior Publication Data

US 2009/0284560 A1 Nov. 19, 2009

(30) Foreign Application Priority Data

May 14, 2008 (JP) ..... 2008-127445

(51) Int. Cl.
*B41J 29/38* (2006.01)

(52) U.S. Cl. ..... 347/16; 347/5; 270/58.07

(58) Field of Classification Search ..... 347/5, 7, 347/9, 16, 19, 76; 270/58.07
See application file for complete search history.

(56) References Cited

U.S. PATENT DOCUMENTS 5,905,510 A * 5/1999 Hagiwara et al. ..... 347/7
7,621,288 B2 * 11/2009 Evans ..... 135/76

FOREIGN PATENT DOCUMENTS

JP 4-55256 2/1992
JP 2007-156229 6/2007

* cited by examiner

*Primary Examiner* — Lam S Nguyen
(74) *Attorney, Agent, or Firm* — Oblon, Spivak, McClelland, Maier & Neustadt, L.L.P.

(57) ABSTRACT

An inkjet printing apparatus that can perform printing with a single printing speed even in a case of being connected with a post-processing apparatus having a different transport speed, and that can suppress increased apparatus costs. A discharge transport portion positioned at a connection side of a post-processing apparatus of the inkjet printing apparatus is constituted by transport roller pairs and discharge roller pairs, and is capable of being driven independently from the inkjet transport portion. When the transport speed of the post-processing apparatus is different from the printing speed, printed papers are temporarily stopped at the discharge transport portion. After this, transport recommences with a predetermined timing matched to the transport speed of the post-processing apparatus, and papers are fed to the post-processing apparatus. In a case of continuous printing, a distance between the papers (paper feeding interval) is adjusted in the inkjet printing apparatus to enable transport jams to be avoided.

5 Claims, 10 Drawing Sheets

INKJET PRINTING APPARATUS

BACKGROUND OF THE INVENTION

1. Field of the Invention

The present invention relates to an inkjet printing apparatus that ejects ink droplets from a nozzle to form an image.

2. Description of the Related Art

In this type of inkjet printing apparatus, the transport speed (hereinafter also referred to as "printing speed") is generally constant. This is because adjustment control of the ink ejection amounts becomes complicated when the transport speed is variable.

Incidentally, in a case where post-processing apparatuses such as sorters, staplers, and sorter/staplers are connected, the processing speed (transport speed) of the post-processing apparatus and the printing speed of the inkjet printing apparatus are not necessarily consistent. Generally, compared to the transport speeds of post-processing apparatuses, the transport speeds are greater in inkjet printing apparatuses, whose development has advanced focusing on ever greater printing speeds, and in a case where there is a connection to a post-processing apparatus, it is necessary to match the printing speed of the inkjet printing apparatus to the transport speed of the post-processing apparatus.

However, in a case of attempting to match the printing speed of the inkjet printing apparatus with the transport speed of the post-processing apparatus, from a perspective of usability, it is necessary to maintain the printing speed when the inkjet printing apparatus is used in a standalone manner without being connected to the post-processing apparatus.

Thus, it is necessary to ensure the inkjet printing apparatus has two printing speeds, and for this reason there must be two printing modes in the inkjet printing section, which complicates control and makes it impossible to avoid greatly increased apparatus costs.

Technologies relating to the present invention are disclosed in Japanese Patent Application Laid-open Nos. H04-055256 and 2007-156229 for example.

SUMMARY OF THE INVENTION

The present invention has been devised in light of the aforementioned conventional problem, and its object is to provide an inkjet printing apparatus that can perform printing with a single printing speed even in a case of being connected with a post-processing apparatus having a different transport speed, and that can suppress increased apparatus costs.

In an aspect of the present invention, an inkjet printing apparatus carries out printing using an inkjet printing portion while transporting a recording medium by an inkjet transport portion. A discharge transport portion can be driven independently from the inkjet transport portion and is capable of arbitrarily temporarily stopping the recording medium. The discharge transport portion is provided on a downstream side of the inkjet printing portion in a transport direction of the recording medium.

BRIEF DESCRIPTION OF THE DRAWINGS

The above and other objects, features, and advantages of the present invention will become more apparent from the following detailed description taken with the accompanying drawings in which.

DESCRIPTION OF THE PREFERRED EMBODIMENT(s)

Hereinafter, embodiments of the present invention are described with reference to the accompanying drawings.

Figure 1:
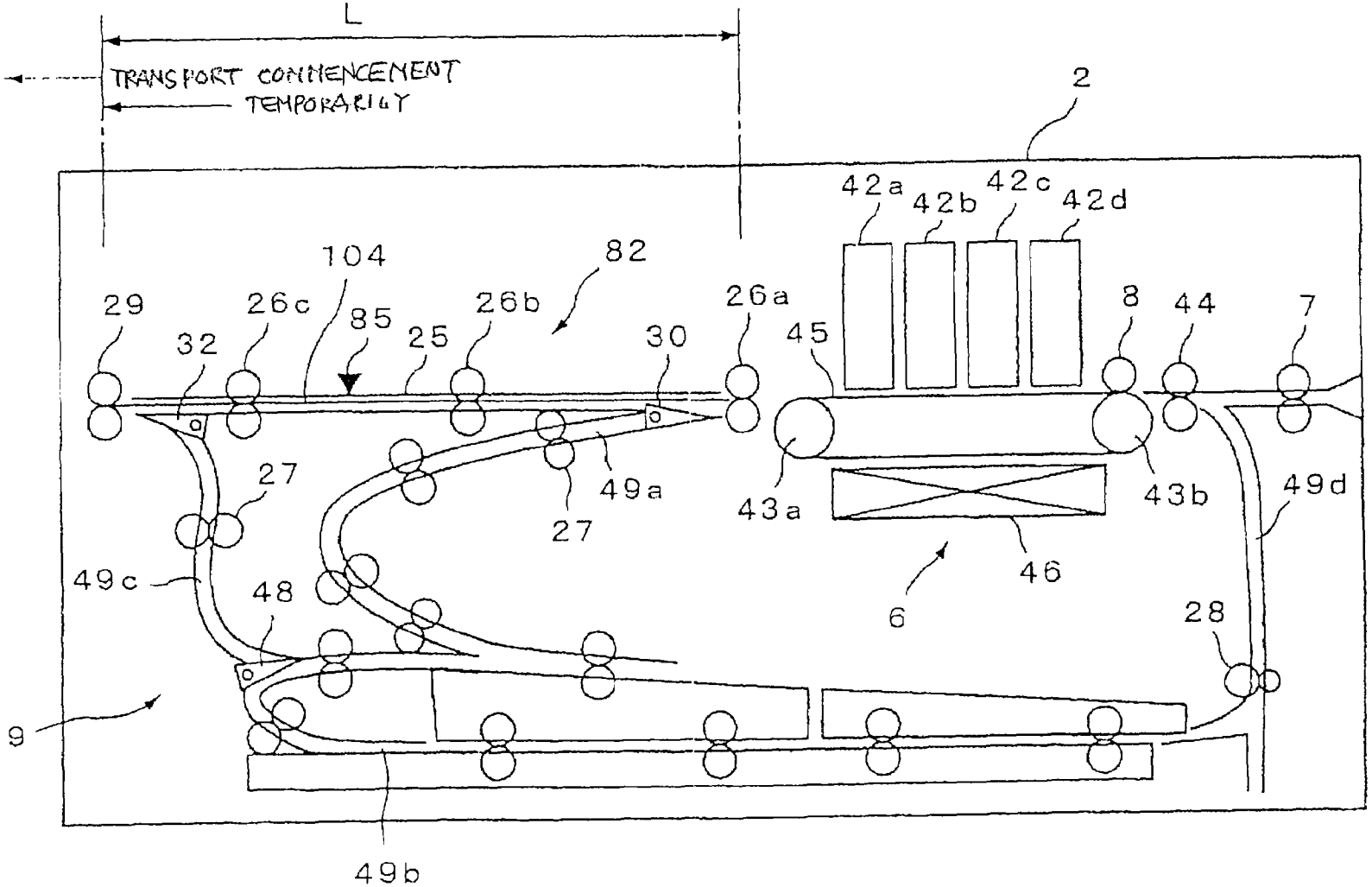
FIG. 1 is a front view showing an outline configuration of an inkjet printing apparatus according to a first embodiment of the present invention.
Figure 2:
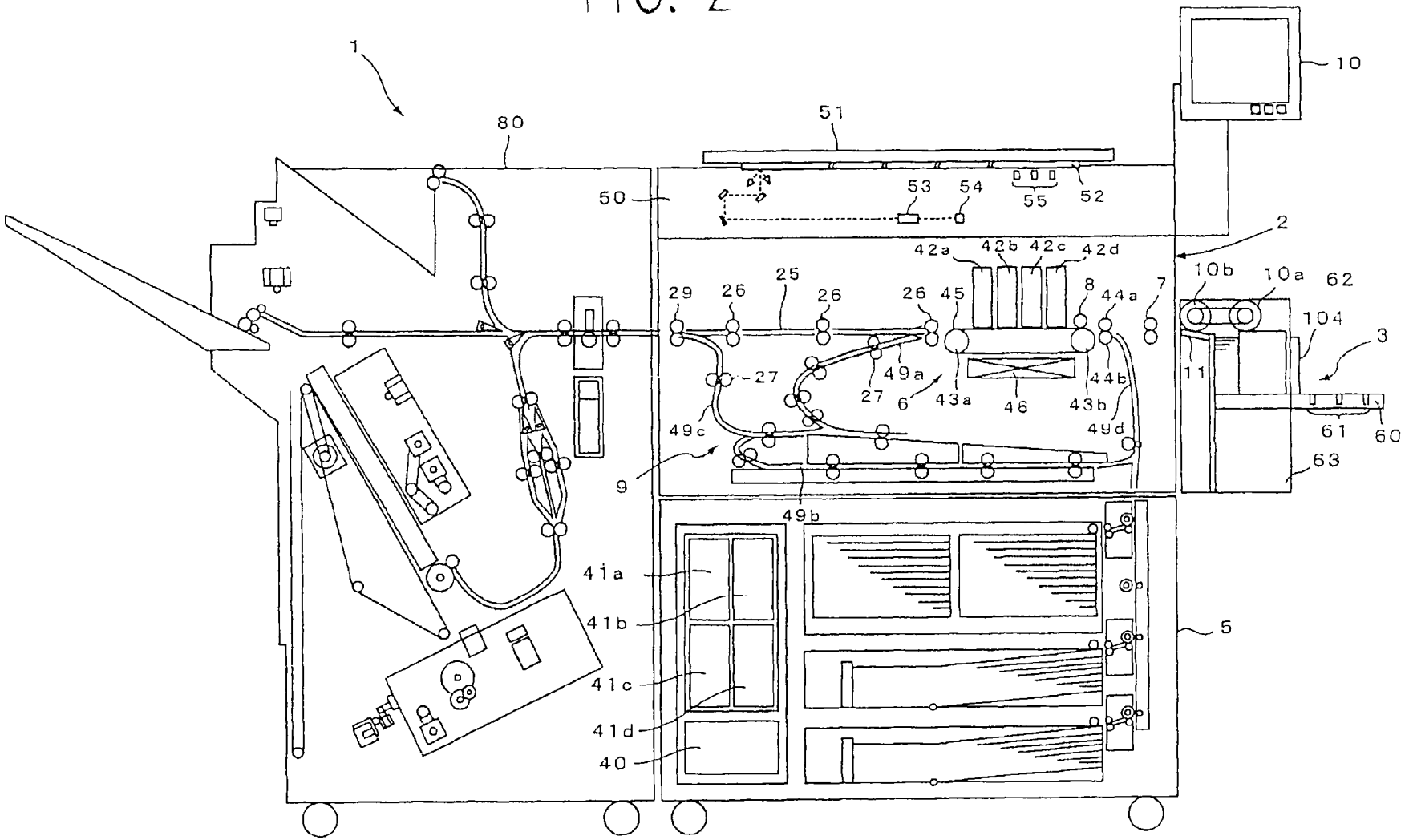
FIG. 2 is a front view showing an outline configuration of an inkjet printing system that includes this inkjet printing apparatus.

First, a first embodiment is described based on FIG. 1 through FIG. 8. FIG. 1 shows an outline configuration of an inkjet printing apparatus according to the present embodiment, and FIG. 2 shows an inkjet printing system that includes this inkjet printing apparatus. An inkjet printing system 1 is constituted by an inkjet printing apparatus 2, a paper feeding device 3 as a large capacity paper feeding device connected to the inkjet printing apparatus 2 on the right side in FIG. 2, a post-processing apparatus 80 connected to the inkjet printing apparatus 2 on the left side in FIG. 2, and a bank paper feeding device 5 as a large capacity paper feeding device arranged at a lower side of the inkjet printing apparatus 2.

Here, the paper feeding device 3 is positioned as an optional component with respect to the inkjet printing apparatus 2, but these may also be considered as constituent component of the inkjet printing apparatus 2.

The inkjet printing apparatus 2 has an inkjet printing portion not shown in FIG. 1 or FIG. 2 (indicated by symbol 20 in FIG. 8), an image reading portion 50, and an operation panel 10 and the like. Line type inkjet print heads (hereinafter referred to as "print heads") are arranged for four colors as recording heads in the inkjet printing portion, which is arranged substantially centrally in the inkjet printing apparatus 2 but is not shown in FIG. 1 or FIG. 2.

That is, a print head 42*a* for Y (yellow), a print head 42*b* for M (magenta), a print head 42*c* for C (cyan), and a print head 42*d* for Bk (black) are arranged in order from a downstream side to an upstream side in a paper feeding direction.

Ink of each color of an ink bottle 41*a* for Y (yellow), an ink bottle 41*b* for M (magenta), an ink bottle 41*c* for C (cyan), and an ink bottle 41*d* for Bk (black), which are arranged inside the bank paper feeding device 5, is supplied to the print heads 42*a*, 42*b*, 42*c*, and 42*d*, which are configured as dedicated heads of the four colors.

An ink pump is arranged inside each ink bottle, and ink is supplied to each of the print heads in accordance with a signal from a control means, which is described later.

A remaining ink amount detection sensor not shown in FIG. 1 or FIG. 2 is arranged at each ink bottle and is configured to output as a signal to the control means the remaining ink amount in the bottle. Based on this signal, the remaining ink amount is displayed on the operation panel 10.

Figure 3:
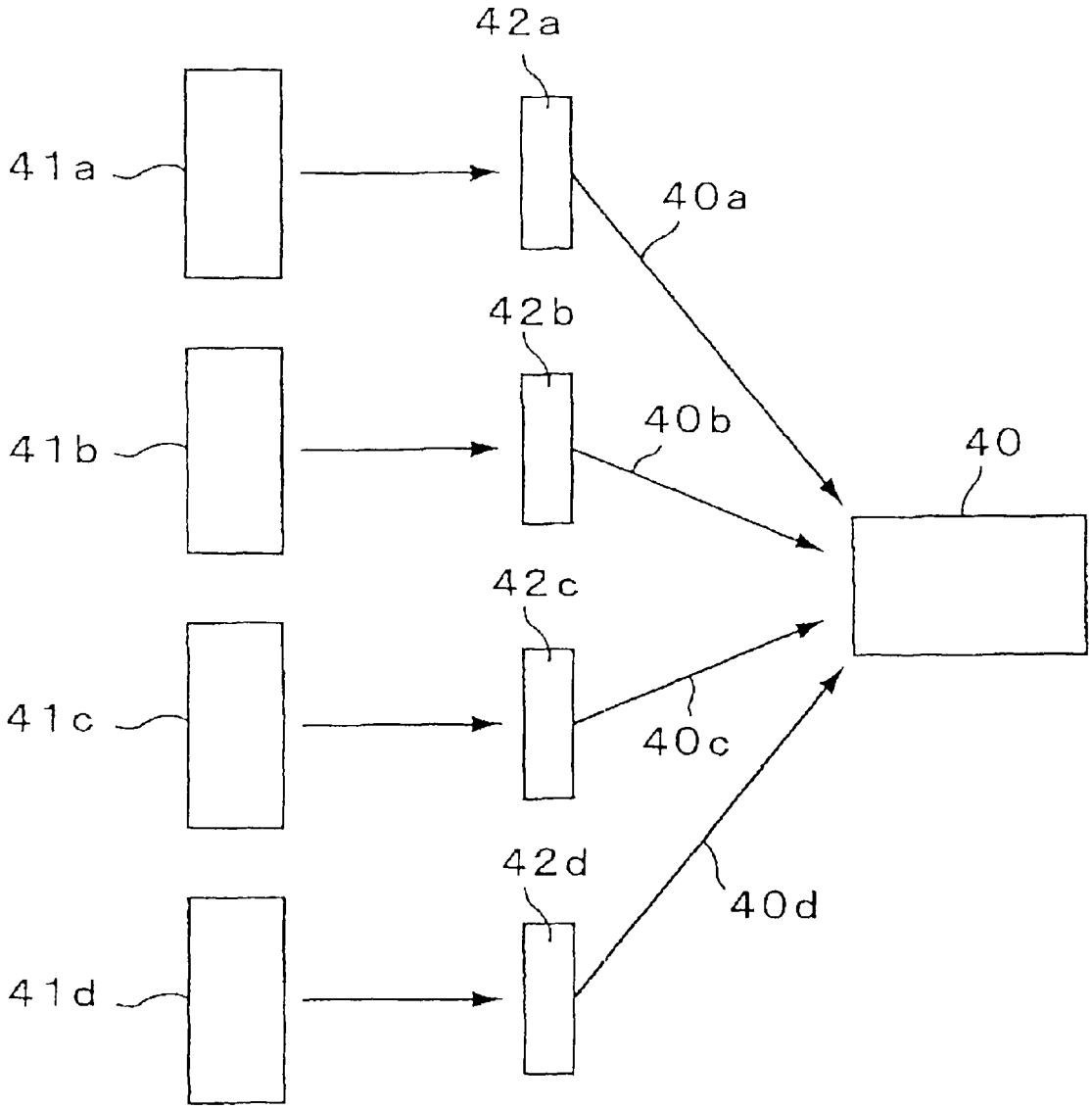
FIG. 3 is a diagram showing recovery routes of ink from an inkjet printing portion to a waste liquid tank.

As shown in FIG. 3, when cleaning the print head 42, waste liquid is collected in a waste liquid tank 40 arranged inside the bank paper feeding device 5 via waste liquid tubes 40*a*, 40*b*, 40*c*, and 40*d*.

A waste liquid ink full detection sensor not shown in FIG. 3 is arranged in the waste liquid tank 40, and this outputs as a signal to the control means that the waste liquid tank 40 is full of ink. Based on this signal, it is displayed on the operation panel 10 that the waste liquid tank 40 is full.

Although the ink bottles 41 and the waste liquid tank 40 are provided inside the bank paper feeding device 5, they may be provided inside the inkjet printing apparatus 2.

As shown in FIG. 2, an inkjet transport portion 6 is arranged below the inkjet printing portion, which is not shown in FIG. 2. The inkjet transport portion 6 is provided with components such as a drive roller 43*a*, an idler roller 43*b*, an endless belt 45 as a paper transport member, and a suction fan 46; and a paper 104 as a recording medium transported from a separation roller 10*b* of the paper feeding device 3 is attracted and transported to a double-side transport path entrance position 49*a*.

The paper 104 that is fed from the paper feeding device 3 is transported by a pair of transport rollers 7 of the inkjet paper feeding portion not shown in FIG. 1 or FIG. 2, then is temporarily stopped by a pair of registration rollers 44, after which it is transported with a predetermined timing to reach the initial print head 42*d*. The paper 104 travels on the endless belt 45 while being pressed there against by a pressing roller 8.

Although not shown in FIG. 1 or FIG. 2, paper feeding guide panels, which are for guiding the transport of the paper 104 that is fed to the inkjet printing portion from the optional paper feeding device 3 or a double-side inverted discharge portion 9, are arranged respectively on the upstream side and the downstream side of the registration roller pair 44 in the paper transport direction. These unshown paper feeding guide panels are secured respectively between lateral panels not shown in FIG. 1 or FIG. 2.

Figure 4:
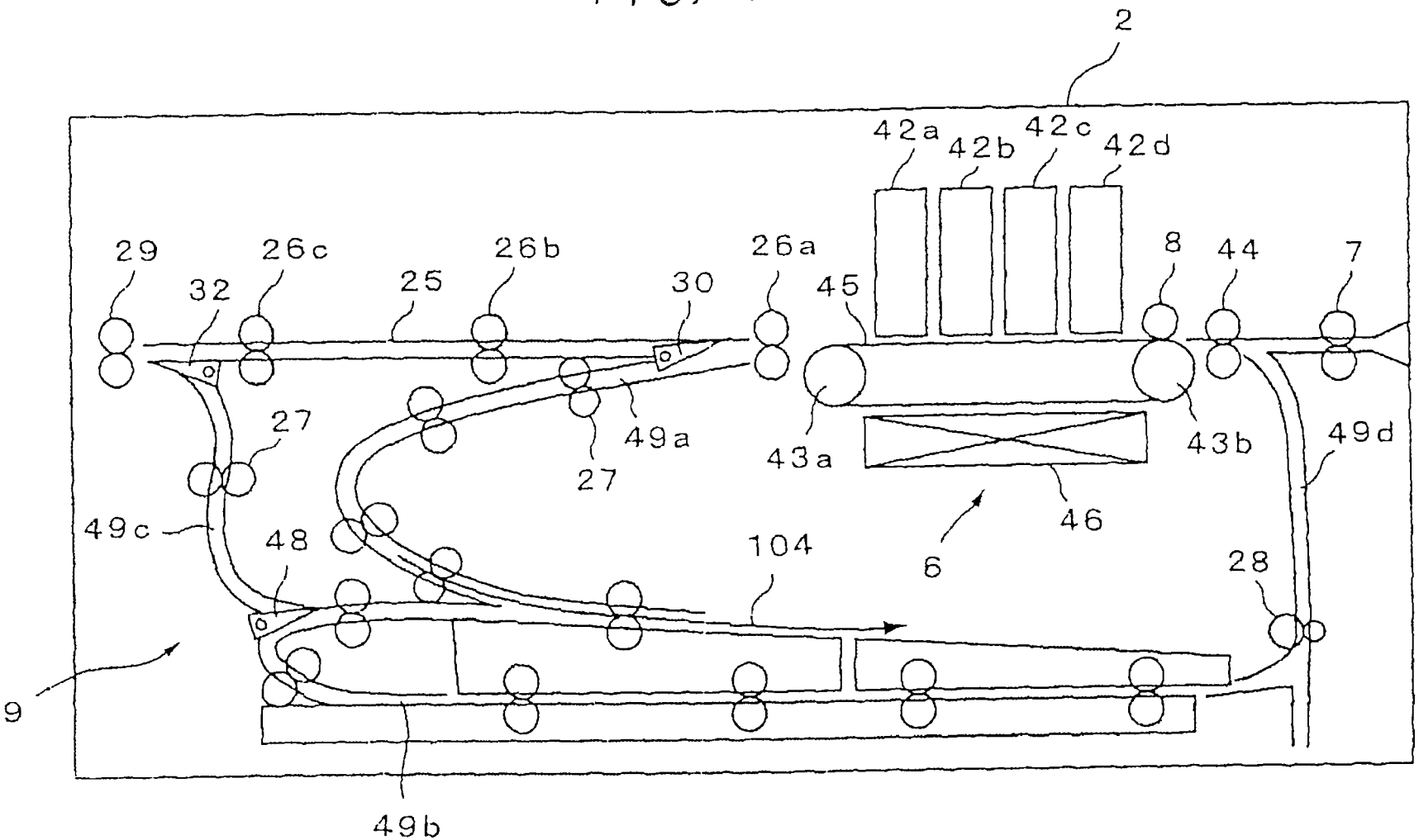
FIG. 4 and FIG. 5 are diagrams showing states of transport during double-side printing in the inkjet printing apparatus.
Figure 5:
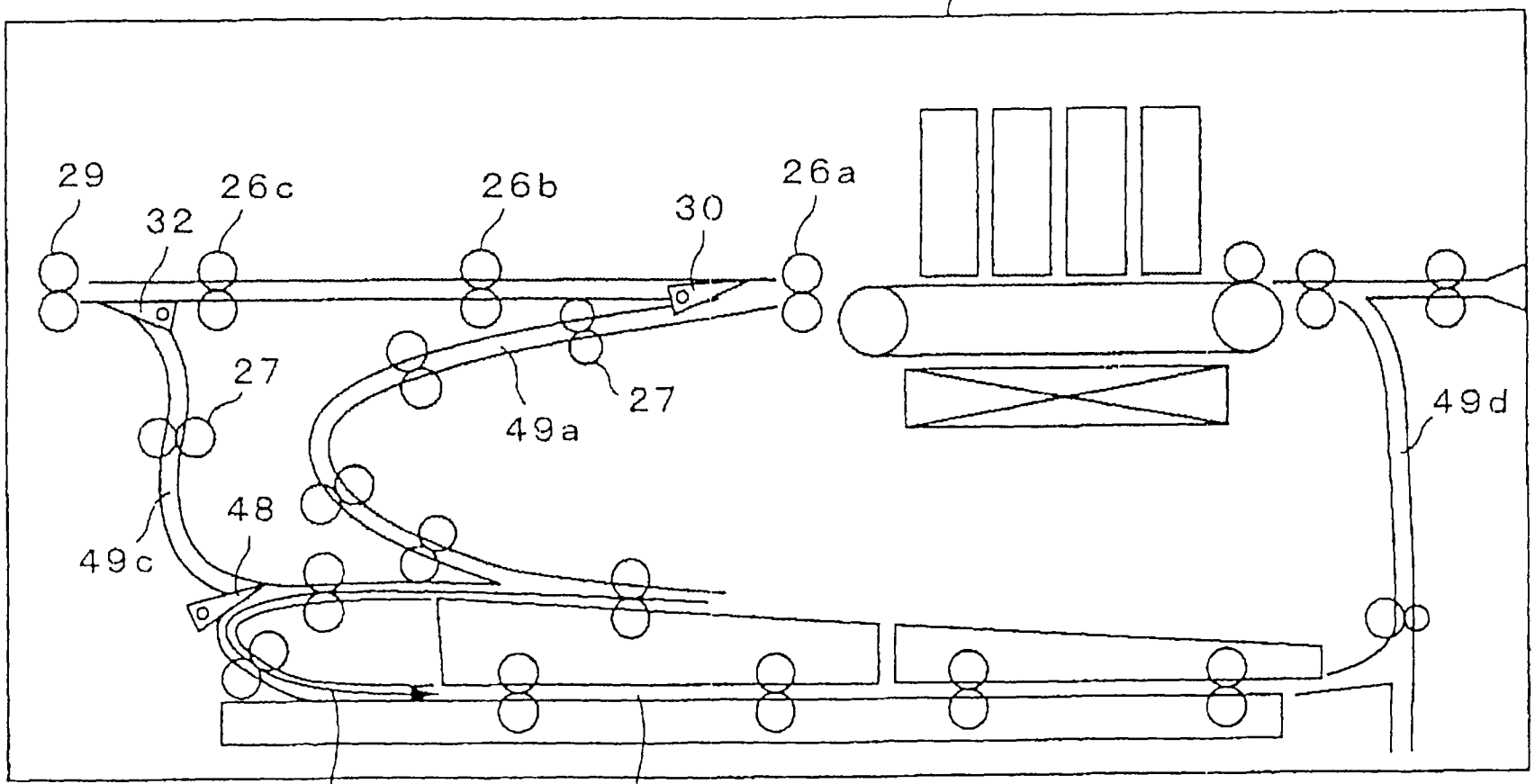
Figure 6:
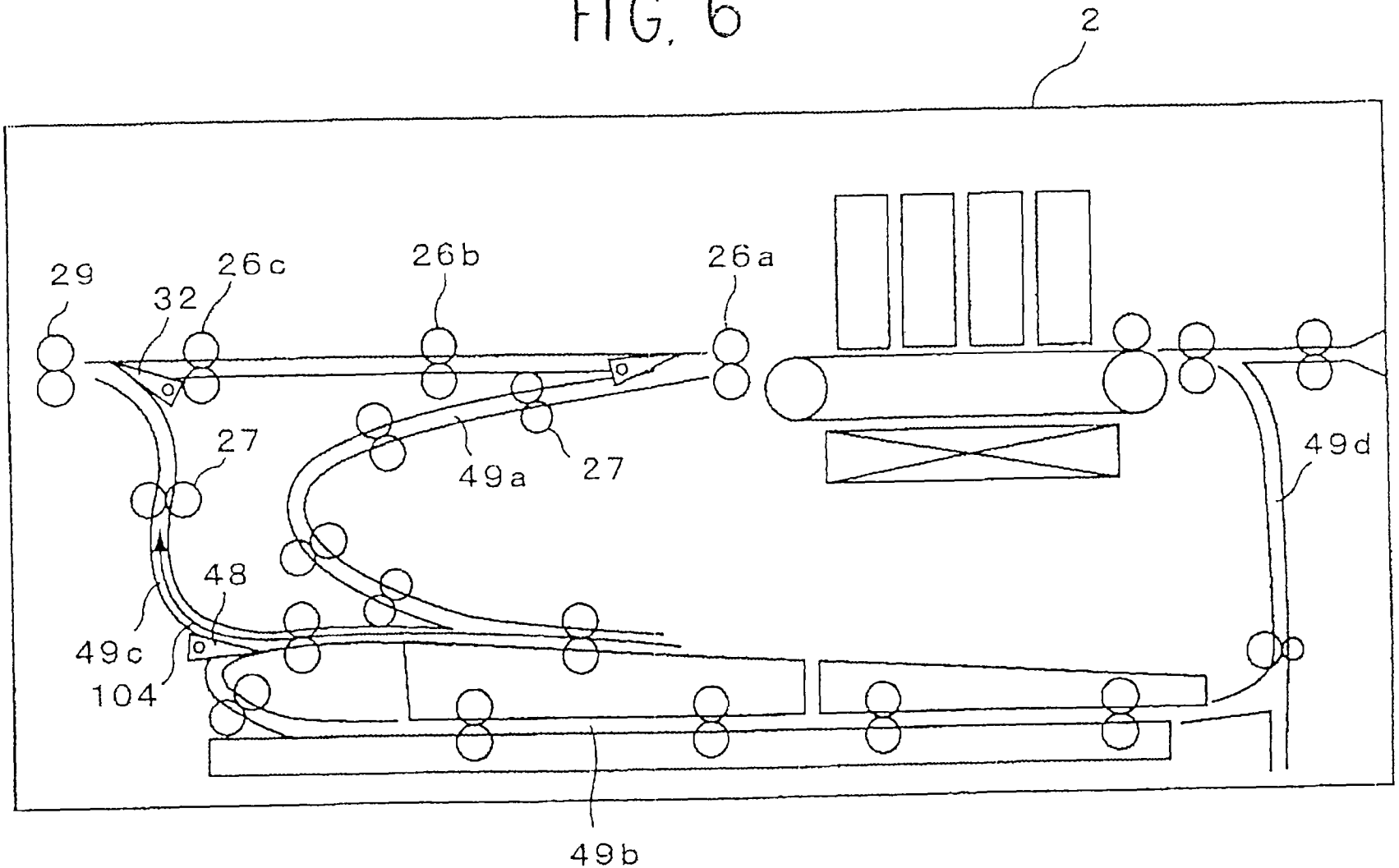
FIG. 6 is a diagram showing a state of transport during inversion discharge.

Description is given using FIG. 4 through FIG. 6 of a configuration and functions of the double-side inverted discharge portion 9.

A transport roller pair 26*a* is arranged near a downstream side of the inkjet transport portion 6 and thereafter the paper 104 is transported by transport roller pairs 26*b* and 26*c*, then sorted to a feed-in transport path 25 in the post-processing apparatus 80 and a double-side transport path 49*a* by a discharge roller pair 29.

A switching claw 30 is arranged at a branching position of these transport paths, and the transport paths can be selectively switched using an operation of this switching claw 30.

In a case of double-side printing, the paper 104 is guided to the double-side transport path 49*a* then transported by the plurality of transport roller pairs 27 as shown in FIG. 4, after which it is transported to an inversion transport path 49*b* as shown in FIG. 5, then transported by the transport roller pair 28 on a vertical transport path 49*d* toward the registration roller pair 44.

In a case of discharge sheets face down (in page order) in single side printing, the paper 104 is guided in the double-side transport path 49*a* as shown in FIG. 6, after which it is directed to an inversion discharge transport path 49*c* due to switching of a switching claw 48, then discharged by the discharge roller pair 29. Symbol 32 indicates a switching claw.

It should be noted that the switching claws 30, 32, and 48 are omitted in FIG. 2.

The image reading portion 50 is arranged at an upper portion of the inkjet printing apparatus 2. The image reading portion 50 is provided with a contact glass 52 onto which originals are placed, a pressure board 51 disposed so as to readily make contact with and move apart from the contact glass 52, an unshown reflective mirror and an unshown fluorescent lamp that scan and read an image of the original, a lens 53 that focuses the scanned image of the original, an image sensor 54 such as a CCD that processes the focused image, a plurality of original size detection sensors 55 that detect a size of the original, and an unshown image memory or the like that stores the image data that has been read, and an operation of reading an image of the original is carried out by an operation of an unshown reading drive means.

Figure 7:
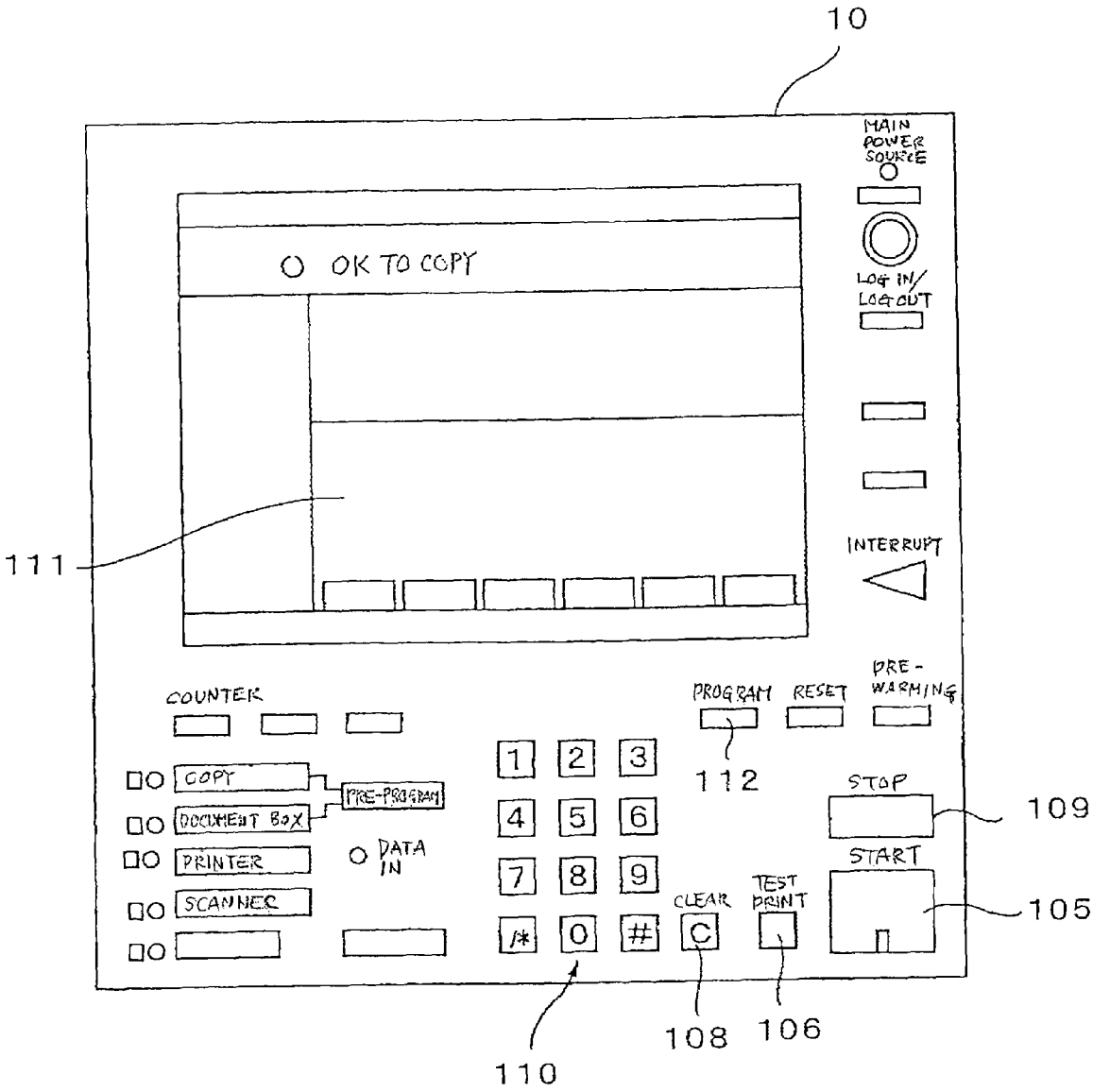
FIG. 7 is a top view showing an outline configuration of an operation panel.

The operation panel 10 is arranged on a right side of the image reading portion 50 of the inkjet printing apparatus 2. As shown in FIG. 7, the operation panel 10 is provided with a print start key 105, a test print key 106, a clear key 108, a stop key 109, numeric keys 110, a display portion ill constituted by an LCD, and a program key 112, as well as an enter key, a mode clear key, a four directional key, and an original size setting key and the like, which are unshown.

The print start key 105 is pressed when carrying out a printing operation in the inkjet printing apparatus 2, and after the inkjet printing apparatus 2 goes into a print standby state and various print settings have been performed, the printing operation is carried out by pressing the print start key 105.

The test print key 106 is pressed when carrying out a test print in the inkjet printing apparatus 2, and after various conditions have been set, printing of a single sheet only is carried out by pressing the test print key 106. The clear key 108 and the stop key 109 are pressed when stopping operation of the inkjet printing apparatus 2 or clearing entered digits, and the numeric keys 110 are used in inputting numeric values.

The enter key is pressed when setting numeric values or the like while carrying out various settings and the program key 112 is pressed when registering or launching commonly carried out operations. The mode clear key is pressed when returning to an initial state by clearing the various modes. The four directional keys include an up key, a down key, a left key, and a right key, and these are pressed in cases such as adjusting an image position during image editing or when selecting a numeric value or an item or the like during various settings.

The original size setting key is pressed when arbitrarily inputting an original size, and the paper size inputted by the original size setting key is given priority over the original size detected by the paper size detection sensor 61.

The display device 111 constituted by the LCD is structured as a hierarchical display, and is configured to enable changes to various modes such as scaling and positional adjustments and the settings of various modes by the pressing of selection setting keys arranged therebelow. Furthermore, as shown in FIG. 7, in addition to showing the state of the inkjet printing apparatus 2 such as "OK to print," the display device 111 also displays alarms such as paper feeding or discharge jams and supply indications such as the supply of papers and inks.

Figure 8:
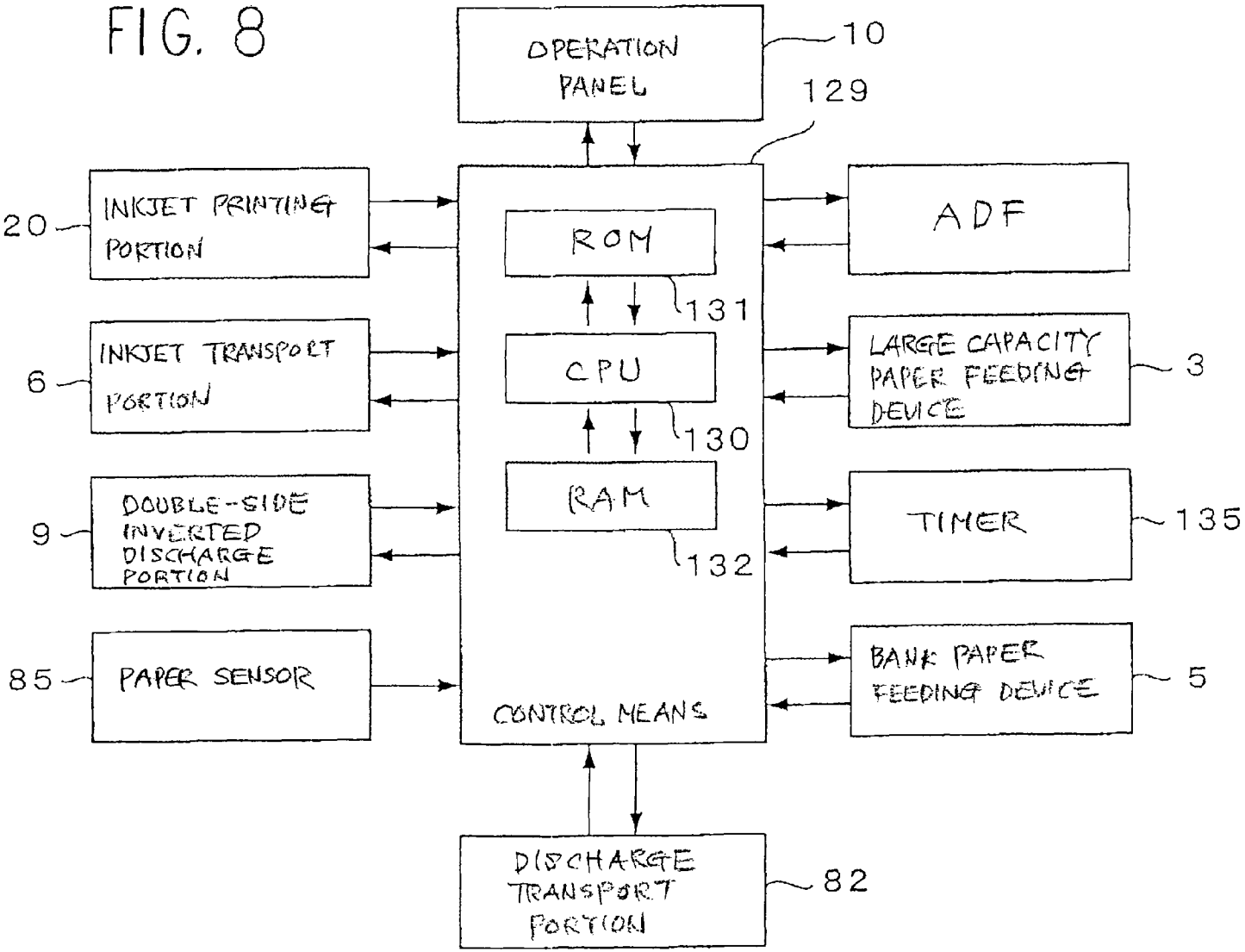
FIG. 8 is a block diagram showing a configuration of a control system.

FIG. 8 shows a configuration of a control system of the inkjet printing apparatus 2. In FIG. 8, a control means 129 is a commonly known microcomputer having internally a CPU 130, a ROM 131, and a RAM 132 and, although not shown in FIG. 8, is arranged inside the apparatus main unit. Based on various signals from the operation panel 10, detection signals from the various sensors arranged in the inkjet printing apparatus main unit, and operation programs called up from the ROM 131, the CPU 130 controls transport member drive motor operations and the like of various drive means arranged in the inkjet printing portion 20, the inkjet transport portion 6, the inkjet paper feeding portion, the double-side inverted discharge portion 9, and the image reading portion 50, and controls overall operations of the inkjet printing apparatus.

Operation programs of the entire inkjet printing apparatus are stored in the ROM 131 and these operation programs are called up as necessary by the CPU 130. The RAM 132 has functions such as a function of temporarily storing calculation results of the CPU 130 and a function of storing as needed the settings and inputted data signals and on/off signals from the various keys of the operation panel 10 and the various sensors.

Description is given of operations of the inkjet printing apparatus 2 based on the above-described configuration.

The inkjet printing apparatus 2 has a function of a printer operation in which inkjet printing is carried out based on image data received from an unshown PC (personal computer) and a copying operation in which inkjet printing is carried out based on image data from an original.

Here, description is given based on the copying operation in which inkjet printing is carried out based on image data from an original.

After print settings have been performed at the operation panel 10, a printing operation is carried out by pressing the print start key 105.

The printing operation involves stacking the papers 104 to be used in printing on a paper feeding tray 60, opening the pressure board 51, and placing the original to be printed on the contact glass 52, after which the pressure board 51 is closed again. After this, printing conditions are set using various keys on the operation panel 10, after which the print start key 105 is pressed.

First, when the print start key 105 is pressed, a paper size detection signal from the paper size detection sensor 61 and an original size detection signal from the original size detection sensor 55 are sent to the control means 129 respectively, and the control means 129 compares the received signals.

At this time, an image reading operation is carried out immediately when the paper size and the original size are the same, but when the paper size and the original size are different, the control means 129 prompts a caution to the operator by displaying information to this effect on the display portion 111 of the operation panel 10.

In a case where the paper size and the original size are different, scaling of magnification or reduction may be carried out automatically under the command of the control means 129 so that the original size and the paper size are matched. And when the print start key 105 is pressed, the image reading portion 50 carries out the reading operation of an image of the original. The reading of the image of the original is carried out reflecting a reflected light exposed by an unshown fluorescent lamp or a xenon lamp using unshown reflection mirrors, and the image of the original that is read is focused by the lens 53, after which it is made incident on the image sensor 54 and undergoes photoelectric conversion. Photoelectrically converted electric signals are inputted to an unshown A/D converter, after which they are stored as image data signals in an unshown image memory.

As shown in FIG. 2, in the optional paper feeding device 3, the paper feeding tray 60, on an upper surface of which a multitude of the papers 104 can be stacked, is supported so as to readily move vertically on the inkjet printing apparatus 2, and is vertically moved by an unshown paper feeding drive means that includes an elevation means.

A pair of side fences 62, which are supported so as to readily move in a paper width direction orthogonal to the paper transport direction on unshown rail members, are provided on the upper surface of the paper feeding tray 60, onto which A3 size papers 104 can be loaded lengthwise. Furthermore, the plurality of paper size detection sensors 61 that detect the size of the stacked papers 104 are arranged on a free end side of the paper feeding tray 60.

A paper feeding roller 10*a* having a highly friction resistant member on its surface is arranged above the paper feeding tray 60. The paper feeding roller 10*a* is supported so as to freely rotate on an unshown bracket that is supported so as to be capable of swinging on the inkjet printing apparatus, and presses against an uppermost paper 104 on the paper feeding tray 60 with a predetermined pressing force when the paper feeding tray 60 is raised by the unshown elevation means. The paper feeding roller 10*a* is rotationally driven by an unshown paper feeding drive means. A separation roller 10*b* and a separation pad 11, each having a highly friction resistant member on its respective surface, are arranged to the left of the paper feeding roller 10*a*. The separation roller 10*b* is drive coupled to the paper feeding roller 10*a* through an unshown timing belt, and is rotationally driven in a same direction in synchronization with the paper feeding roller 10*a* when the paper feeding roller 10*a* is rotationally driven. The separation pad 11 presses against the separation roller 10*b* due to a biasing force of an unshown biasing means.

The registration roller pair 44 is arranged to the left of the separation roller 10*b* and the separation pad 11. The registration roller pair 44, which is constituted by a drive roller 44*b* and an idler roller 44*a*, rotates with a predetermined timing by having a rotational drive force from an unshown drive means transmitted to it by an unshown drive force transmission means such as a gear or a cam or the like, and feeds the paper 104 toward the inkjet printing portion with a predetermined timing.

As described earlier, the inkjet transport portion 6 attracts and transports the paper 104 to the entrance position of the double-side transport path 49*a*. During this transport, the data stored as image data signals in the image memory is separated into four color data for line type inkjet printing, and the color separated data is sent to the print heads 42 for each color.

Due to an unshown head engine of each print head 42, ink droplets are ejected from each of the print heads 42 toward the paper 104 to perform printing. The printed paper 104 is transported from the inkjet transport portion 6 to the double-side inverted discharge portion 9.

In a case where the print setting is for double-side printing without inverted paper discharge, the paper 104 is discharged by the double-side inverted discharge portion 9 without being switched. The discharged paper 104 proceeds to the post-processing apparatus 80 with a predetermined timing.

The post-processing apparatus 80 is an apparatus that carries out tasks such as sorted or punching the papers after printing and is referred to as a sorter or stapler, or a sorter/stapler or finisher or the like. When attempting to connect a post-processing apparatus 80 that is not a specialized high speed enabled post-processing apparatus to the inkjet printing apparatus 2, which is capable of high speed printing, to perform post-processing, the printing speed of the inkjet printing apparatus 2 must be matched to the processing speed of the post-processing apparatus 80 since the printing speed of the inkjet printing apparatus 2 is not matched to the processing speed (transport speed) of the post-processing apparatus 80.

However, in making the printing speed of the inkjet printing apparatus 2 variable to match the processing speed of the post-processing apparatus 80, it is necessary to prepare print condition settings for a plurality of speeds compared to the control of one type for a constant speed, which is detrimental both technically and economically.

To solve this problem, the present embodiment enables support for connection to the post-processing apparatus 80 without changing the printing speed. Description is given of a principle of this below.

The printing speed of the inkjet printing apparatus 2 in the present embodiment is 900 mm/sec, which is a printing speed of 180 sheets/min during continuous printing. The maximum transport speed of the post-processing apparatus 80 is 650 mm/sec, which corresponds to a printing speed of 135 sheets/min.

When connecting and using these apparatuses, the printed papers from the inkjet printing apparatus 2 are sent with a transport speed of 900 mm/sec to the post-processing apparatus 80 having a transport speed of 650 mm/sec. If this was left unchanged, printed papers would not be transported between the apparatuses, which would undesirably result in jamming.

To solve this transport problem, the control means 129 carries out control in which the paper 104 printed by the inkjet printing apparatus 2 is temporarily stopped then sent to the post-processing apparatus with a predetermined timing.

As shown in FIG. 1, the transport roller pairs 26*a*, 26*b*, and 26*c* and the discharge roller pair 29 constitute a discharge transport portion 82 (omitted from FIG. 2 or the like) that can be driven independently from the inkjet transport portion 6. The discharge transport portion 82 has a transport speed of 900 mm/sec equivalent to the inkjet transport portion 6.

The lower side roller of each of these roller pairs is a drive roller and each of the upper side rollers is an idler roller. A paper sensor 85 is provided between the transport roller pairs 26*b* and 26*c* as a paper detection means that detects a leading edge of the paper 104.

Independent driving of the discharge transport portion 82 may involve a drive source separate from the inkjet transport portion 6, and may involve separated drive using clutch control with the same drive source as the inkjet transport portion 6.

The control means 129 stops the driving of the discharge transport portion 82 after a predetermined time when the leading edge of the paper 104 is detected by the paper sensor 85, thereby temporarily stopping the paper 104. Here, "predetermined time" is a time obtained by a timing in which the leading edge of the paper 104 stops at a position of the discharge roller pair 29 for example.

The arrangement position of the paper sensor 85 is not limited to this and may use as a reference a trailing edge of the paper 104. Further still, it is also possible to perform the stopping of the discharge transport portion 82 by carrying out time measurements using as a reference the paper feeding timings from the paper feeding device 3 or the bank paper feeding device 5 without providing the paper sensor 85.

Based on the transport timing information in the post-processing apparatus 80, the control means 129 commences driving of the discharge transport portion 82 so as to match this, and commences transport of the paper 104 that had been temporarily stopped.

Furthermore, as described above, the transport speed of the post-processing apparatus 80 corresponds to a speed of 135 sheets/min when expressed as a printing speed, and therefore the control means 129 carries out adjustments of the distance between sheets, that is, adjustments in which the interval between sheets is widened so as to match this with the printing speed of the inkjet printing apparatus 2.

In this way, even when there is a difference in the transport speeds between the inkjet printing apparatus 2 and the post-processing apparatus 80, the printed papers 104 can be smoothly fed to the post-processing apparatus 80 without causing transport jams.

When a trailing edge portion of the paper 104 (an upstream side end portion in the transport direction) has passed a position of the transport roller pair 26*a* and is present on the upstream side while the paper 104 is temporarily stopped, that is, when it is present in a region of the inkjet transport portion 6, there is a risk that the trailing edge portion of the paper will contact the endless belt 45 and be damaged or contact the print head 42 and become soiled.

To solve problems such as these, the present embodiment sets a transport direction length L of the discharge transport portion 82 to a magnitude at which the trailing edge portion of the largest size paper does not jump to the upstream side from the transport roller pair 26*a*.

Furthermore, in the present embodiment, the branching portion for selectively guiding to the discharge transport portion 82 and the double-side inverted discharge portion 9 is provided on a paper transport direction upstream side of the discharge transport portion 82, and therefore the aforementioned control for temporarily stopping, double-side printing, and inversed paper discharge can be carried out arbitrarily.

Of course, when the post-processing apparatus 80 is not connected, control can be switched so that the papers 104 are not temporarily stopped.

Figure 9:
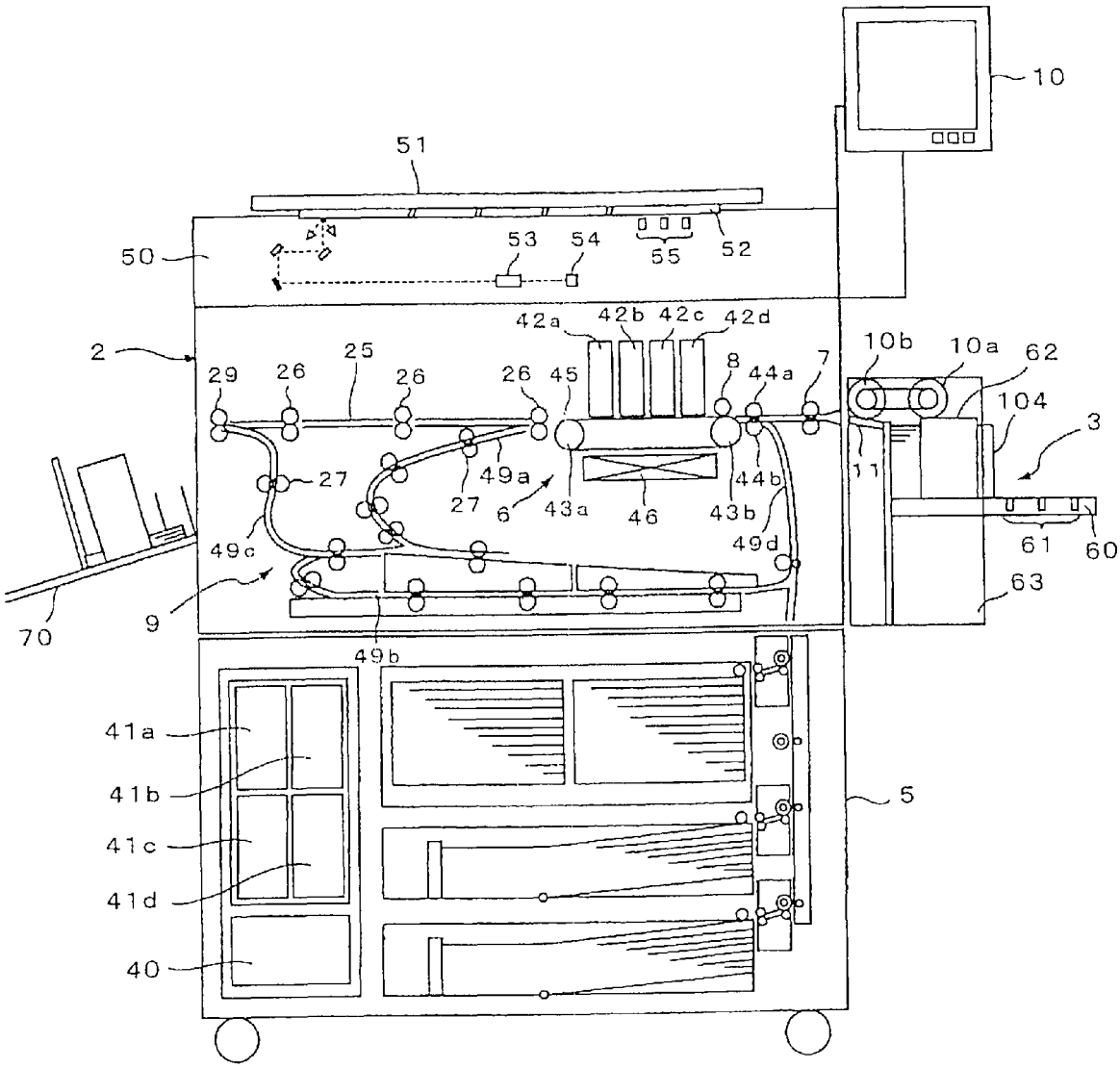
FIG. 9 a front view showing an outline configuration of an inkjet printing apparatus according to a second embodiment of the present invention.

Description is given of a second embodiment according to the present invention based on FIG. 9.

It should be noted that identical symbols are assigned to identical portions in the aforementioned embodiment, and description of configurations and functions already described are omitted when not particularly necessary so as to describe only essential portions (hereinafter the same is true for other embodiments).

In the present embodiment there is a configuration in which paper discharge is performed to a discharge tray 70 without a connection to the post-processing apparatus 80, and the discharge transport portion 82 is switchable among a plurality of levels of transport speeds.

As described earlier, the printing speed of the inkjet printing portion (the transport speed of the inkjet transport portion 6) is 900 mm/sec, but the transport speed of the discharge transport portion 82 is selectively switchable up to a maximum of 1,000 mm/sec.

When the discharge tray 70 is mounted, the papers can stacked be stacked in an orderly manner by having the leading edge of the papers impact against an unshown end fence of the discharge tray 70. To ensure that the leading edge of the discharged papers reliably impact against the end fence, it is necessary to increase the discharge speed.

From this perspective, in the present embodiment, the transport speed of the discharge transport portion 82 is set higher than the inkjet transport portion 6 at 1,000 mm/sec when discharging to the discharge tray 70 without connecting to the post-processing apparatus 80.

Figure 10:
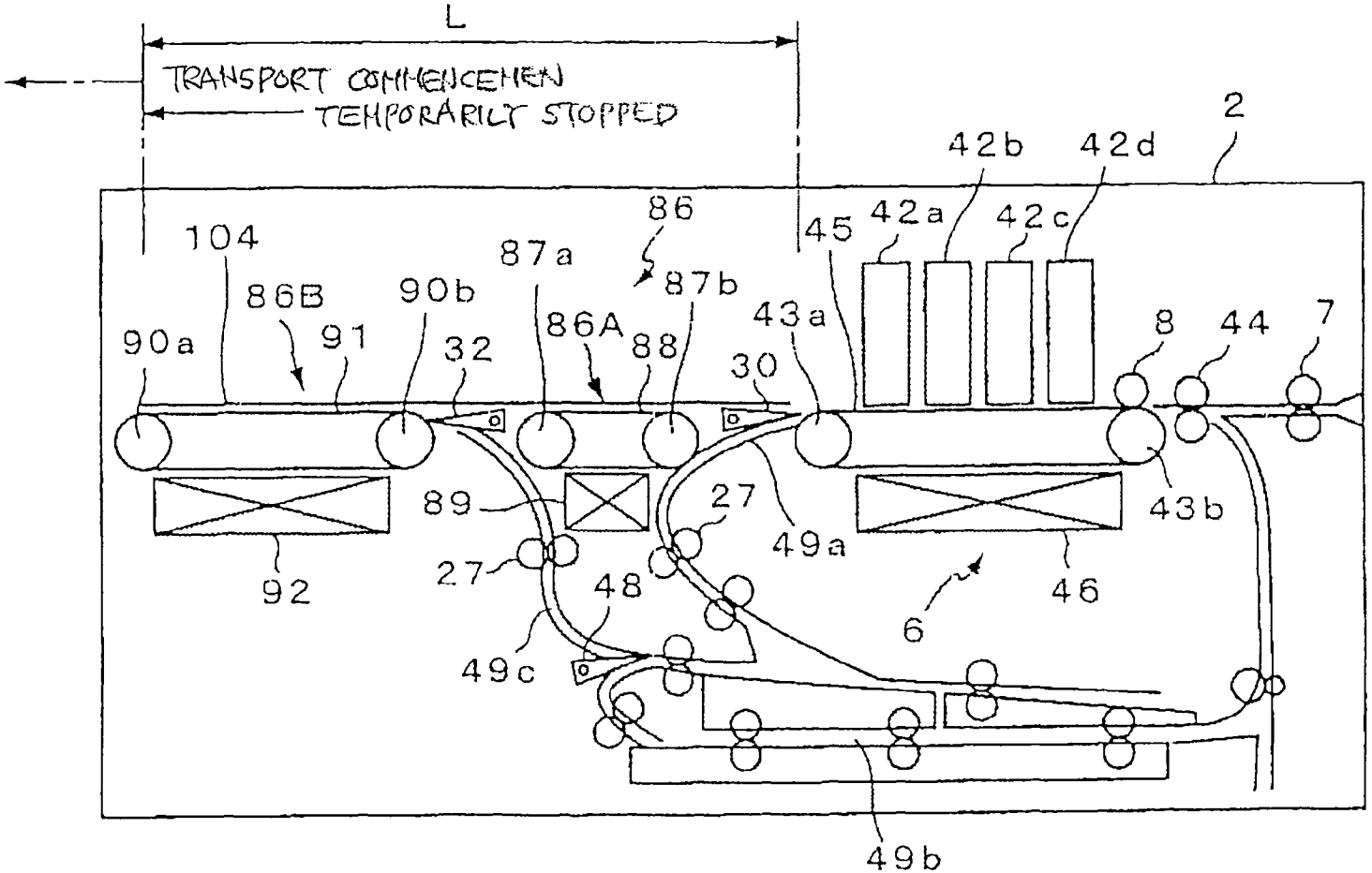
FIG. 10 is outline front view of an inkjet printing apparatus according to a third embodiment.

Description is given of a third embodiment according to the present invention based on FIG. 10.

An object of the present embodiment is to solve a problem in which roller marks are made on the print surface during transport by the transport roller pairs and a problem such as the roller surfaces becoming soiled by printing.

A point of difference compared to the configuration of FIG. 1 is that rather than a roller pair transport system, a discharge transport portion 86 employs a suction transport system.

The discharge transport portion 86 is constituted by a first discharge transport portion 86A positioned between the switching claw 30 and the switching claw 32 and a second discharge transport portion 86B. It should be noted that the switching claw 30 and the switching claw 32 also contribute as portions of a transport path of a discharge transport portion 88.

The first discharge transport portion 86A is constituted by components such as a drive roller 87*a*, an idler roller 87*b*, an endless belt 88, and a suction fan 89. The second discharge transport portion 86B is constituted by components such as a drive roller 90*a*, an idler roller 90*b*, an endless belt 91, and a suction fan 92.

When the post-processing apparatus 80 is connected, the leading edge portion of the paper 104 printed by the inkjet printing portion is temporarily stopped in a state where it is positioned at a transport direction leading edge portion of the endless belt 91, then is fed to the post-processing apparatus 80 matched to the transport timing of the post-processing apparatus 80.

The first discharge transport portion 86A and the second discharge transport portion 86B are driven by the same drive source or are synchronized, and their timings for stopping are the same as in the foregoing embodiments.

With the present embodiment, even when there is a difference in the transport speeds between the inkjet printing apparatus 2 and the post-processing apparatus 80, the printed papers 104 can be smoothly fed to the post-processing apparatus 80 without causing transport jams.

Furthermore, rather than transport using the roller pairs, a suction transport system is used that does not involve touching the printed surface, and therefore ink soiling during transport can be prevented. In transport using roller pairs, the roller pairs may become soiled when a transport jam is cleared for example, but here there is no risk of that. It is also possible to prevent roller marks being left on the printed surface.

Of course, when the post-processing apparatus 80 is not connected, control can be switched so that the papers 104 are not temporarily stopped.

With the present invention, in a case of connecting to a post-processing apparatus having a different transport speed, problems caused by the transport speed of the post-processing apparatus and the printing speed not matching can be avoided while maintaining a single printing speed. For this reason, it is not necessary to have design changes of making the printing speed variable in anticipation of a case where the transport speed of the post-processing apparatus is different, and therefore increases in apparatus costs can be suppressed. Furthermore, it is not necessary to ensure that the post-processing apparatus is a specialized component that supports the printing speed, and therefore improved convenience can be achieved.

Various modifications will become possible for those skilled in the art after receiving the teachings of the present disclosure without departing from the scope thereof.

What is claimed is:

1. An inkjet printing apparatus, comprising:

an inkjet printing portion;

an inkjet transport portion which transports a recording medium while the inkjet printing portion is printing; and a discharge transport portion, which can be driven independently from the inkjet transport portion and is capable of arbitrarily temporarily stopping the recording medium, the discharge transport portion disposed at a downstream side of the inkjet printing portion in a transport direction of the recording medium, wherein, when a post-processing apparatus having a transport speed lower than the printing speed of the inkjet printing portion is connected at a downstream side of the discharge transport portion in the transport direction of the recording medium, control is performed such that after the discharge transport portion is temporarily stopped, transport recommences with a timing matched to the transport speed of the post-processing apparatus, and a supply interval of the recording medium to the inkjet printing portion is increased.

2. The inkjet printing apparatus as claimed in claim 1, wherein a transport speed of the discharge transport portion is switchable among a plurality of levels and one of the transport speeds of the plurality of levels is higher than a printing speed of the inkjet printing portion.

3. The inkjet printing apparatus as claimed in claim 1, wherein the discharge transport portion is configured so as to be capable of attracting and transporting the recording medium.

4. The inkjet printing apparatus as claimed in claim 1, wherein the discharge transport portion has a length not less than a maximum transport direction size of a usable recording medium.

5. The inkjet printing apparatus as claimed in claim 1, further comprising:

a double-side inverted discharge portion that enables double-side printing; and a branching portion for selectively guiding between the discharge transport portion and the double-side inverted discharge portion arranged at an upstream side of the discharge transport portion in the transport direction of the recording medium.

* * * * *

UNITED STATES PATENT AND TRADEMARK OFFICE

CERTIFICATE OF CORRECTION

PATENT NO. : 8,152,264 B2
APPLICATION NO. : 12/402958
DATED : April 10, 2012
INVENTOR(S) : Mituru Takahashi It is certified that error appears in the above-identified patent and that said Letters Patent is hereby corrected as shown below:

At column 4, line 19, after the word portion, change "ill" to "111".

Signed and Sealed this
Twenty-fourth Day of July, 2012

David J. Kappos

David J. Kappos
*Director of the United States Patent and Trademark Office*